US007082686B2

(12) United States Patent
Anderson

(10) Patent No.: US 7,082,686 B2
(45) Date of Patent: Aug. 1, 2006

(54) ANGLED SHANK BLADE

(76) Inventor: Martin L. Anderson, 6852 Estes Ave. NW., Maple Lake, MN (US) 55358

( * ) Notice: Subject to any disclaimer, the term of this patent is extended or adjusted under 35 U.S.C. 154(b) by 83 days.

(21) Appl. No.: 10/980,586

(22) Filed: Nov. 3, 2004

(65) Prior Publication Data

US 2005/0060891 A1 Mar. 24, 2005

Related U.S. Application Data

(63) Continuation-in-part of application No. 10/305,216, filed on Nov. 26, 2002, now Pat. No. 6,813,834.

(51) Int. Cl.
*B26B 9/00* (2006.01)

(52) U.S. Cl. ..... 30/169; 30/357; 30/349; 299/36.1

(58) Field of Classification Search ..... 30/167, 30/168, 169, 170, 314, 315, 346, 348, 349, 30/352, 357; 299/36.1, 37.1
See application file for complete search history.

(56) References Cited

U.S. PATENT DOCUMENTS 4,860,450 A * 8/1989 Achille ..... 30/172

FOREIGN PATENT DOCUMENTS

EP 1 541 782 A1 * 6/2005

* cited by examiner

*Primary Examiner*—Hwei-Siu Payer
(74) *Attorney, Agent, or Firm*—Nikolai & Mersereau, P.A.

(57) ABSTRACT

An angled shank blade for a carpet or tile stripping machine with a flat bottomed blade for engaging the surface of a floor. The leading edge of the blade having an angle of about 20 degrees, followed by a tapered top surface portion and a rear portion. An angled blade head attached to the rear portion and angled upward at about 20 degrees. A shank attached to the blade at an angle of about 20 degrees for receiving the weight of the floor stripping machine and keeping the blade parallel to the floor while lifting the flooring material over the leading edge, the tapered portion, the blade head and shank smoothly and efficiently without binding. The blade may have a carbide insert for long lasting skiving of material from the floor.

12 Claims, 2 Drawing Sheets

ANGLED SHANK BLADE

CROSS-REFERENCE TO RELATED APPLICATIONS

This application is a continuation-in-part of Ser. No. 10/305,216 filed Nov. 26, 2002, now U.S. Pat. No. 6,813, 834.

BACKGROUND OF THE INVENTION

1. Field of the Invention

This invention relates to blades for carpet and tile floor stripping machines and more particularly to an angled shank blade.

2. Description of the Related Art

There are many types of floor stripping machines. In one type the blades engaging the floor are angled downward and have a large force pushing down on the blade so that it engages the floor at an angle and strips the ceramic tiles, carpet, tile, adhesives and other material from the floor. The blade tips dull quickly and have to be changed frequently.

Another type of floor stripping machine has a blade resting on the floor like a plow with a pushing force applied behind the blade parallel to the floor. However it is difficult to keep the blade flat on the floor and the blade will ride up over the material to be stripped.

In other blades the blade head would interfere with the material being lifted off the floor and increase the amount of energy needed to propel the floor stripping machine.

Prior blades for floor stripping machines would have a large angle of taper after the cutting edge requiring an excessive amount of force to lift the material off the floor. Other blades would have a small taper but would be too thin to keep the blade from vibrating and bending thus the blade tip would bend and engage the floor cutting downward into the flooring or cutting upward into the material rather than skive the material from the floor. Further the bottom surface of the blade would snake up and down wasting energy and presenting the floor with a not smooth blade surface, which increases the energy needed to push the blade along the floor.

SUMMARY OF THE INVENTION

The angled stripper blade has a shoe portion for riding on the floor and having the weight of the machine on it for engaging the floor. A blade on the front portion of the shoe is held parallel to the floor for skiving the ceramic tiles, carpet, tile, adhesive or other material from the floor surface. The blade angle relative to the floor is optimized for stripping the floor. A tapered portion after the blade tip helps lift the carpet or flooring material up off the floor gradually. The blade head at the rear of the blade and attached at an angle such that the carpet or flooring material is lifted up by the blade head to avoid being caught thereon. An optional carbide tip on the blade is stronger and last longer than a metal blade and can be changed easily when the tip gets dull.

OBJECTS OF THE INVENTION

It is an object of the invention to quickly and easily strip a floor of ceramic tiles, carpet, tile, adhesives and other materials.

It is an object of the invention to provide a blade tip, which lasts longer without becoming dull.

It is an object of the invention to provide a stripper blade, which is easy to change.

It is an object of the invention to provide an angled blade with weight on the blade to keep the blade parallel to the floor.

It is an object of the invention to hold the blade at an optimal angle to strip the floor.

It is an object of the invention to have a tapered portion of the blade to lift the carpet or flooring material off the floor gradually providing a longer release time for the material to be lifted from the floor.

It is an object of the invention to have an angled head at the rear of the blade to continue to lift the carpet or flooring material at the angle of the leading edge of the blade to avoid the carpet or flooring from getting caught on the angled head.

It is an object of the invention to have a shank parallel to the angled head so that the material being lifted from the floor does not get caught on the shank.

It is an object of the invention remove flooring with the least power requirement of the floor stripping machine.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
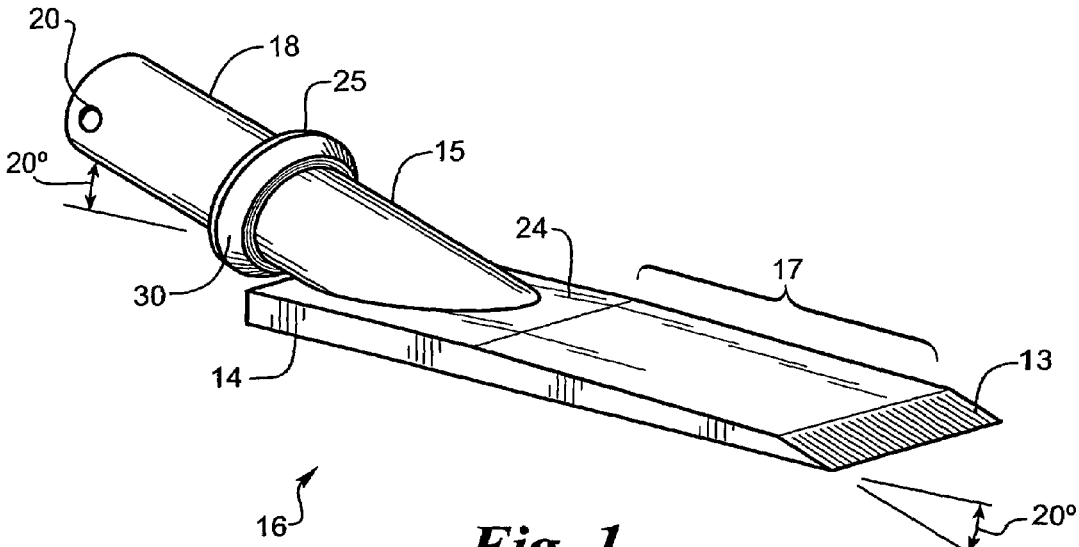
FIG. 1 is a perspective view of the angled blade shank with a longer blade.

The blade 16 is used to skive flooring material such as ceramic tiles, carpeting or other flooring materials from a floor when used in conjunction with a floor stripping machine. The floor stripping machine may push forward on the blade 16 or use a combination of pushing forward along with side to side movements or orbital movements. The leading edge 13 of the blade 16 has an angle of about 20 degrees with respect to the floor. It lifts the material from the floor at the front of the blade 16. The blade then has tapered portion 17 for further lifting the flooring material or carpet from the floor at a small angle to allow the material time to release from the floor as the blade moves forward thus using less energy in lifting the flooring then a blade with a steeper angle of attack. The rear portion 14 of the blade 16 is at a uniform height with a flat top surface 24 and supports the blade head 15. The blade head 15 is preferably angled at about 20 degrees to match the angle of the leading edge 13 so that the flooring material is further lifted at the blade head 15 and the attached shank 18 to avoid the material becoming caught on and binding on the material while it is being lifted and the stripper machine moves forward. The rear portion 14 of blade 16 is thick enough and strong enough to support the stripper machine and keep the tapered portion 17 of the blade 16 from bending as it is being pushed forward. The tapered portion 17 allows the leading edge 13 to have a smaller height, which aids in skiving material from the floor. The tapered portion 17 then helps further lift the material from the floor over a longer length reducing the power needed by the stripping machine. The angled interface of the blade head 15 with the blade 16 allows the material being removed from the floor to slide up the head and the attached shank 18 since the angle of the leading edge 13 and the blade head 15 are approximately same, therefore eliminating catching on the material or increasing the angle of attack on the material which would increase the power required of the stripping machine to move forward.

A collar 25 on the blade head 15 allows the shank 18 to be connected to the blade head 15. The collar 25 has approximately the same diameter as the shank 18 and the blade head 15 at the leading edge angled surface 30 of the collar to reduce the chances snagging on the material being lifted from the floor.

The shank 18 has a connecting aperture 20 to secure the shank to the stripping machine. The shank can be easily removed from the stripping machine to change blades 16 should the leading edge 13 become dull or breaks.

The shank 18 is preferably at approximately the same angle as the blade head 15 and leading edge 13 but need not be at approximately the same angle as the flooring material being removed from the floor will not likely engage the shank 18 due to being reflected away by the collar 25 which preferably has an angled surface 30.

Figure 2:
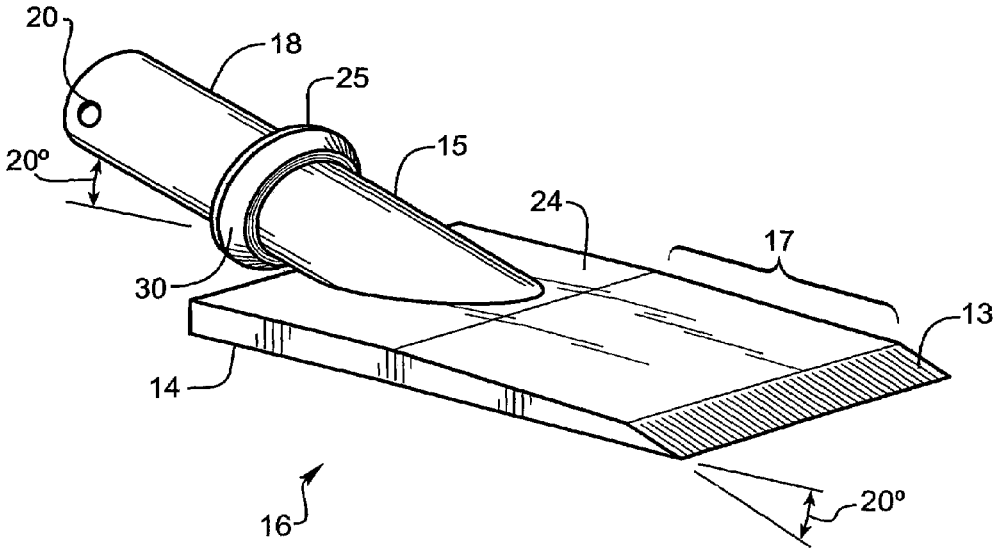
FIG. 2 is a perspective view of the angled blade shank with a shorter blade.

As shown in FIG. 2 the tapered portion 17 of blade 16 can be of varying lengths and have different beginning and ending thicknesses. The variables depend on the materials used for the blade. In some embodiments a 1095 spring steel was used and in another embodiment a 1018 cold roll case hardened steel was used. The object is to provide a blade 16 which will not bend, or snake as it is being pushed forward by the stripping machine so that the tip does not dive into the floor surface or up into the flooring material. The leading edge 13 should remain pointing forward. The blade should preferably be on the order of 6.35 to 12.7 millimeters (0.25 to 0.5 inches) thick at the rear of the blade 14.

Figure 3:
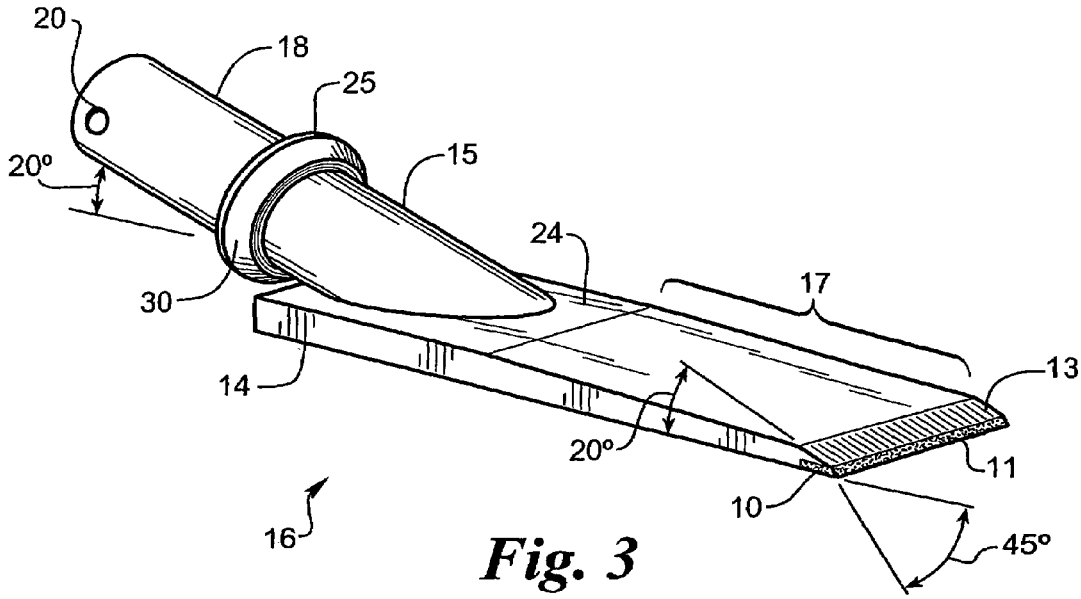
FIG. 3 is a perspective view of the angled blade shank with a longer blade with a carbide insert at the blade tip.

In FIG. 3 a carbide insert 10 is attached to the leading edge 13 to provide for a stronger leading edge for use on ceramic tiles or other hard surfaces. In the embodiment shown the carbide insert 10 has a 45 degree angle of attack nose 11 followed by the leading edge of the blade 13 having a 20 degree angle of attack which has been found to be effective for removing ceramic tiles from floors. The tapered portion 17 of the blade is aft of the leading edge 13 with the rear 14 of the blade 16 having a flat top surface 24.

Blades 16 should be made from material with enough stiffness to prevent snaking of the materials or too much vibration. Snaking tends to let the blade dig into the floor or into the material to be lifted from the floor rather than skive the material from the floor. Snaking and vibration also increases the energy needed to power the floor stripping machine because of the inefficiency of the skiving process and the energy being wasted in creating the vibrations in the blade which increases the noise of the machine and increases wear.

The blades 16 can be on the order of about 203.2 millimeters to about 279.4 millimeters (8 to 11 inches) long with a leading edge 13 of about 25.4 millimeters (1 inch) in length, a tapered portion 17 of about 76.2 to about 152.4 millimeters (about 3 to about 6 inches) in length and a rear blade portion 14 of about 101.6 millimeters (4 inches) in length to receive the blade head 15.

The leading edge 13 can have a height of from 0 millimeters to about 7.62 millimeters (0 to about 0.30 inches). The tapered portion 17 can then rise from about 7.62 millimeters to about 10.16 millimeters (about 0.30 inches to about 0.43 inches). The flat surfaced rear portion of the blade can have a height of about 10.16 millimeters (0.43 inches.)

The blade 16 can be on the order of about 50.8 millimeters (2 inches) to 101.6 millimeters (4 inches) wide.

Figure 4:
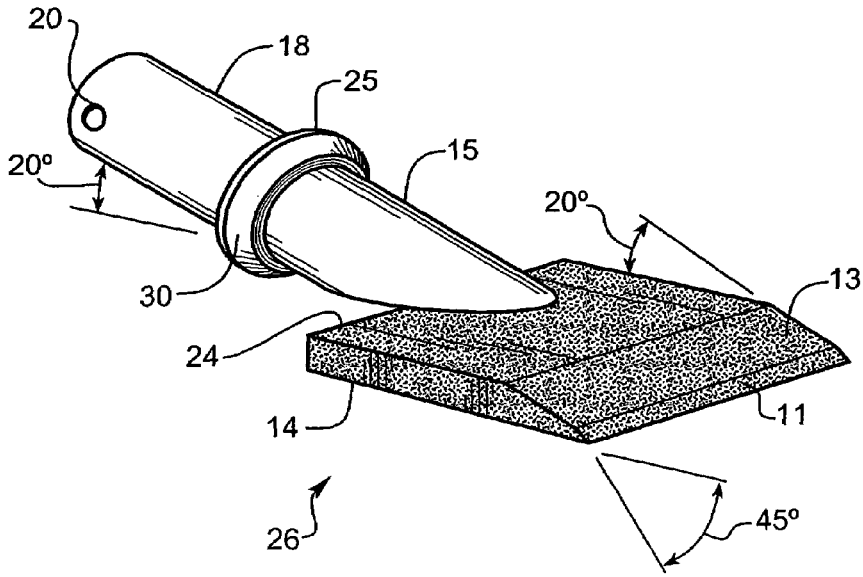
FIG. 4 is a perspective view of the angled shank blade having a carbide blade without a tapered portion.

In another embodiment as shown in FIG. 4 the blade 26 can be entirely made of a carbide material for strength. As shown the nose 11 is at a 45 degree angle relative to the floor followed the leading edge 13 having a 20 degree angle relative to the floor and then a rear blade portion 14 having a flat top portion 24 for attaching a blade head 15 having a top surface approximately angled at the same angle as the leading edge 13. The shank 18 is attached to collar 25 on blade head 15 as in the previous embodiments. With the carbide blade 26 the blade length can be shorter than the previously disclosed blades. Since the nose 11 provides a steep angle of attack on the flooring and the leading edge 13 has a much lower angle of attack the taper 17 can be reduced or as shown eliminated entirely. The flooring sliding over the leading edge 13 also slides over blade head 15 which is similarly angled.

The applicant's copending patent application Ser. No. 10/305,216 filed Nov. 26, 2002 is attached hereto and incorporated herein by reference. The prior application of which this is a continuation-in-part differs partly in the placement and shape of the blade head, which in the prior application was not angled at the same angle as the leading edge of the blade and partly in that the blade was not tapered after the leading edge.

The materials used, the angles of the leading edge, tapered portion and blade head may all vary as well as the lengths and heights of the various parts of the blade so long as the flooring material is smoothly lifted off the floor and lifted over the blade and blade head without interference and binding and creating minimum vibrations and noise.

Obviously, many modifications and variations of the present invention are possible in light of the above teachings. It is therefore to be understood that, within the scope of the appended claims, the invention may be practiced otherwise than as specifically described.

What is claimed is:

1. A floor stripping blade comprising:

a blade portion having a flat bottom surface, a leading edge portion angled relative to the floor for skiving flooring material from a floor, a rear portion having a flat top surface aft of the leading edge portion, a blade head attached to the rear portion and angled approximately at the same angle relative to the floor as the leading edge portion, a shank attached to the blade head for connecting the floor stripping blade to a floor stripping machine at an angle such that the weight of the floor stripping machine rests on the flat bottom surface of the blade portion resting on the floor in front of the floor stripping machine.

2. A floor stripping blade as in claim 1 wherein:

the blade portion has a tapered portion between the leading edge portion and the rear portion.

3. A floor stripping blade as in claim 1 wherein:

the leading edge portion angled approximately 20 degrees upward with respect to the floor.

4. A floor stripping blade as in claim 2 wherein:

the leading edge portion angled approximately 20 degrees upward with respect to the floor.

5. A floor stripping blade as in claim 1 wherein:

a carbide insert attached to the front of the leading edge portion of the floor stripping blade.

6. A floor stripping blade as in claim 2 wherein:

a carbide insert attached to the front of the leading edge portion of the floor stripping blade.

7. A floor stripping blade as in claim 5 wherein:

the carbide insert has a nose portion with an angle of approximately 45 degrees with respect to the surface of the floor for efficiently skiving material from the floor.

8. A floor stripping blade as in claim 6 wherein:

the carbide insert has a nose portion with an angle of approximately 45 degrees with respect to the surface of the floor for efficiently skiving material from the floor.

9. A floor stripping blade as in claim 1 wherein:

the shank has a top surface angled at approximately the same angle as the blade head.

10. A floor stripping blade as in claim 2 wherein:

the shank has a top surface angled at approximately the same angle as the blade head.

11. A floor stripping blade as in claim 1 wherein:

a nose portion for skiving flooring material from a floor attached at the front of the leading edge portion.

12. A floor stripping blade as in claim 2 wherein:

a nose portion having an angle of about 45 degrees with respect to the floor for skiving flooring material from a floor attached at the front of the leading edge portion.

* * * * *

UNITED STATES PATENT AND TRADEMARK OFFICE

CERTIFICATE OF CORRECTION

PATENT NO. : 7,082,686 B2
APPLICATION NO. : 10/980586
DATED : August 1, 2006
INVENTOR(S) : Martin L. Anderson It is certified that error appears in the above-identified patent and that said Letters Patent is hereby corrected as shown below:

Col. 4, line 57, Claim 3, line 2, after "portion" insert -- is --.

Col. 4, line 60, Claim 4, line 2, after "portion" insert -- is --.

Col. 4, line 63, Claim 5, line 2, after "insert" insert -- is -- and change "the" (first occurrence) to -- a --.

Col. 4, line 66, Claim 6, line 2, after "insert" insert -- is -- and change "the" (first occurrence) to -- a --.

Col. 5, line 3, Claim 7, line 3, change "the" to -- a --.

Col. 5, line 7, Claim 8, line 3, change "the" to -- a --.

Col. 6, line 5, Claim 11, line 2, change "a" (second occurrence) to -- the --.

Col. 6, line 6, Claim 11, line 3, change "the" (first occurrence) to -- a --.

Col. 6, line 10, Claim 12, line 4, after "floor" insert -- is -- and change "the" (first occurrence) to -- a --.

Signed and Sealed this
Thirteenth Day of November, 2012

David J. Kappos

David J. Kappos
*Director of the United States Patent and Trademark Office*